US007743952B2

(12) United States Patent
Auer et al.

(10) Patent No.: US 7,743,952 B2
(45) Date of Patent: Jun. 29, 2010

(54) DOUBLE BEAD SEALING SYSTEM FOR CONTAINER CLOSURE

(75) Inventors: Robert T. Auer, East Stroudsburg, PA (US); Gene Stull, Sr., Far Hills, PA (US)

(73) Assignee: Stull Technologies, Inc., Somerset, NJ (US)

( * ) Notice: Subject to any disclaimer, the term of this patent is extended or adjusted under 35 U.S.C. 154(b) by 445 days.

(21) Appl. No.: 11/583,568

(22) Filed: Oct. 18, 2006

(65) Prior Publication Data

US 2008/0093396 A1 Apr. 24, 2008

(51) Int. Cl.
*B65D 25/40* (2006.01)

(52) U.S. Cl. ..... 222/570; 222/525; 222/546; 222/566; 222/569; 215/237; 215/245; 215/354

(58) Field of Classification Search ..... 222/569–570, 222/546, 562, 519–525, 542, 566, 567; 215/237, 215/245, 344–345, 354; 220/833–835
See application file for complete search history.

(56) References Cited

U.S. PATENT DOCUMENTS

| | | | | | |
|---|---|---|---|---|---|
| 2,894,654 | A | | 7/1959 | Lohrer | |
| 3,001,659 | A | | 9/1961 | Schultz | |
| 3,032,226 | A | | 5/1962 | Terwilliger | |
| 3,057,503 | A | | 10/1962 | Salzmann | |
| 3,109,547 | A | * | 11/1963 | Wood | 215/256 |
| 3,109,548 | A | * | 11/1963 | Wood | 215/256 |
| 3,168,969 | A | * | 2/1965 | Krieps | 222/520 |
| 3,186,573 | A | * | 6/1965 | Salminen | 215/270 |
| 3,240,405 | A | * | 3/1966 | Abbott | 222/543 |
| 3,254,785 | A | | 6/1966 | Lovell | |
| 3,275,178 | A | * | 9/1966 | Lovell et al. | 215/277 |
| 3,294,294 | A | * | 12/1966 | Amburgey | 222/525 |
| 3,473,685 | A | | 10/1969 | Karlan | |
| 3,540,612 | A | | 11/1970 | Brady | |
| 3,693,847 | A | | 9/1972 | Gibson | |
| 3,717,287 | A | * | 2/1973 | Marand | 222/153.14 |
| 3,877,598 | A | * | 4/1975 | Hazard | 215/224 |
| 3,924,771 | A | | 12/1975 | Cleff | |
| 3,940,005 | A | * | 2/1976 | Granat | 215/325 |
| 3,944,104 | A | | 3/1976 | Watson et al. | |
| 4,279,353 | A | | 7/1981 | Honma | |
| 4,342,400 | A | | 8/1982 | Llera | |
| 4,380,304 | A | | 4/1983 | Anderson | |
| 4,583,665 | A | | 4/1986 | Barriac | |
| 5,046,630 | A | * | 9/1991 | Schneider et al. | 215/321 |
| 5,385,253 | A | * | 1/1995 | Scharf et al. | 215/296 |
| 5,497,906 | A | * | 3/1996 | Dubach | 222/23 |

(Continued)

*Primary Examiner*—Frederick C. Nicolas
(74) *Attorney, Agent, or Firm*—Drinker Biddle & Reath, LLP

(57) ABSTRACT

The present invention is a container closure for a bottle or other similar container having a neck. The closure includes a top ring, a downwardly depending skirt, and a hollow generally cylindrical downwardly depending plug seal. The plug seal having a varied thickness with a relatively thick proximal end and tapers to a relatively thinner midpoint. The plug seal further extends at a substantially constant thickness to a distal end. The plug seal includes an upper annular bead and a lower annular bead on the outer surface thereof. The lower bead is slightly larger than the upper bead. The upper bead is located coincident with or near the midpoint of the plug seal and the lower bead is located at or near the distal end of the plug seal.

12 Claims, 2 Drawing Sheets

U.S. PATENT DOCUMENTS 5,954,215 A * 9/1999 Alter ..... 215/318
6,024,255 A 2/2000 Long, Jr.
6,702,134 B2 * 3/2004 Scalese et al. ..... 215/344
6,851,586 B2 * 2/2005 Odet ..... 222/541.9
2005/0051508 A1 * 3/2005 Hackmann et al. ..... 215/343

* cited by examiner

DOUBLE BEAD SEALING SYSTEM FOR CONTAINER CLOSURE

FIELD OF THE INVENTION

The present invention relates generally to container closures, and more particularly to a container closure having a double bead sealing system located on the outside surface of a plug seal for preventing leakage from the container.

BACKGROUND OF THE INVENTION

In many applications of bottles and other containers, it is important that a closure provide a good seal with the container so that the contents of the container do not leak out or are not exposed to contaminants from the environment external to the container. Providing a consistent seal on injection molded containers can be particularly challenging because of the likelihood of small defects on the inside wall of the container neck, created by a scratch in the tooling, by the capping operation, or by some other cause.

Numerous closures are known to incorporate a plug seal depending downardly from a top ring or cap, the plug seal being in intimate contact with the inner neck wall of the container and having a bead or raised annular ridge on the external wall thereof, the beads being used to enhance the seal and/or to increase friction to prevent the closure from being forced off the container by internal pressure. Several prior art designs incorporate two or more beads. See, for example, see U.S. Pat. No. 2,894,654 (Lohrer); U.S. Pat. No. 3,001,659 (Schultz); U.S. Pat. No. 3,032,226 (Terwilliger); U.S. Pat. No. 3,057,503 (Salzmann); U.S. Pat. No. 3,109,547 (Wood); U.S. Pat. No. 3,109,548 (Wood); U.S. Pat. No. 3,473,685 (Karlan); U.S. Pat. No. 3,540,612 (Brady); U.S. Pat. No. 3,693,847 (Gibson); U.S. Pat. No. 3,924,771 (Cleff); U.S. Pat. No. 3,944,104 (Watson); U.S. Pat. No. 4,279,353 (Honma); U.S. Pat. No. 4,342,400 (Llera); and U.S. Pat. No. 4,380,304 (Anderson).

However, the prior art closures suffer from several deficiencies. Some existing closures space the multiple beads closely together, prohibiting each from moving independently of the other(s) to accommodate variations in the container neck wall. Additionally, in some closures, the wall of the plug seal is sufficiently thick along its entire length to impede the independent movement of individual sealing beads. Yet further, the plug seal of some existing closures is enclosed or capped at its distal end, significantly impairing the ability of the plug seal walls and beads to flex to match the container neck wall.

Another deficiency is that the plug seals of many existing closures have thin walls relative to their length, making them difficult to injection mold with consistency. In addition, uniformly thin walls may provide insufficient stiffness where the plug seal attaches to the top ring or cap of a closure. Further, many existing closures have equal sized beads so that if the plug seal wall is able to flex along its length, one or more of the beads may be deformed sufficiently to be no longer in contact with the neck wall around its entire periphery.

SUMMARY OF THE INVENTION

Accordingly, it is an object of the present invention to provide a closure including a plug seal that is thin enough to permit each sealing bead to flex independently while still having sufficient stiffness where the plug seal depends from the top ring. It is another object of the present invention to provide a closure including a plug seal having differently sized upper and lower beads enabling both beads to remain in intimate contact with the neck wall around its entire periphery while the upper and lower beads flex independently. It is yet another object of the present invention to provide a closure including a plug seal that can be injection molded with consistency.

The present invention provides, in one embodiment, a container closure having a top ring and a plug seal depending downwardly from the top ring, the plug seal is designed to be inserted into the neck of a container. The plug seal is a hollow generally cylindrical member comprising at least two annular beads on the external surface thereof. The thickness of the plug seal is varied, tapering from a thicker section at the proximal end thereof, where it attaches to the top ring, to a thinner section at a midpoint thereof, where it transitions to a constant thinner cross-section extending to distal end thereof. The lower bead, disposed distally along the plug seal with respect to the upper bead, is slightly larger than the upper bead. When the plug seal is inserted into the container neck, the lower bead is thus able to flex independently from the upper bead while both beads still maintain contact with the inner neck wall of the container. The lower and upper bead are separated by sufficient distance along the plug seal to accommodate for scratches or variations in the surface of the inner neck wall. Therefore, the container closure of the present invention is capable of providing a superior seal compared with single bead or other multiple bead plug seal designs.

Other objects, advantages, and features of the present invention will become apparent to those skilled in the art upon reading the following detailed description, when considered in conjunction with the appended claims and the accompanying drawings briefly described below.

BRIEF DESCRIPTION OF THE DRAWINGS

For the purpose of illustrating the invention, the drawings show a form of the invention that is presently preferred. However, it should be understood that this invention is not limited to the precise arrangements and instrumentalities shown in the drawings.

DESCRIPTION OF THE INVENTION

Figure 2:
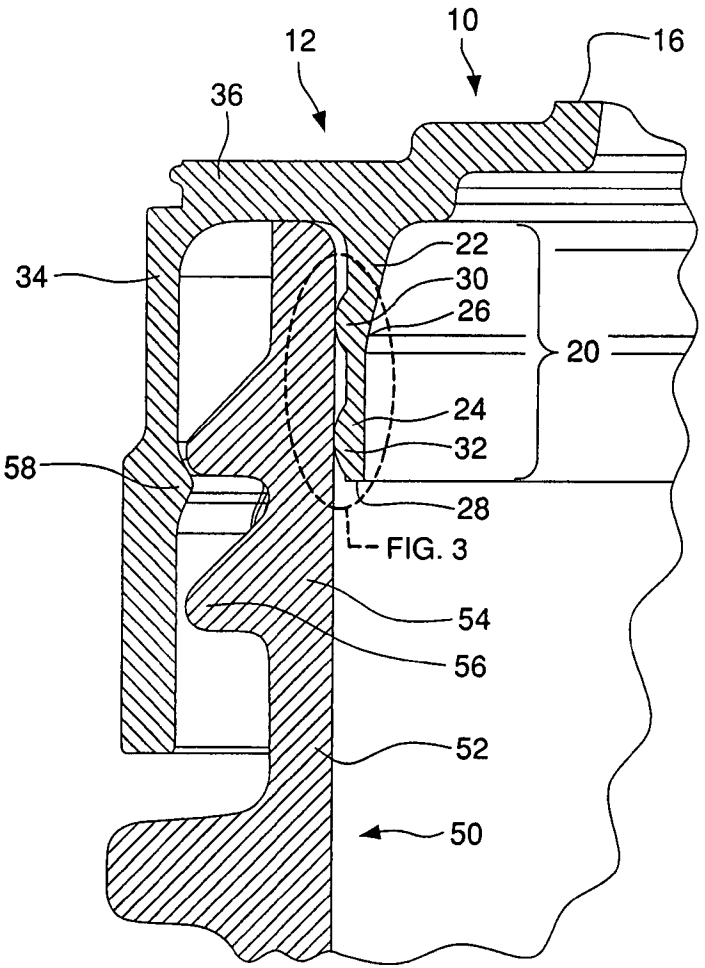
FIG. 2 is a an enlarged partial sectional view of the container closure of FIG. 1, illustrating in detail the double bead sealing system of the present invention.
Figure 1:
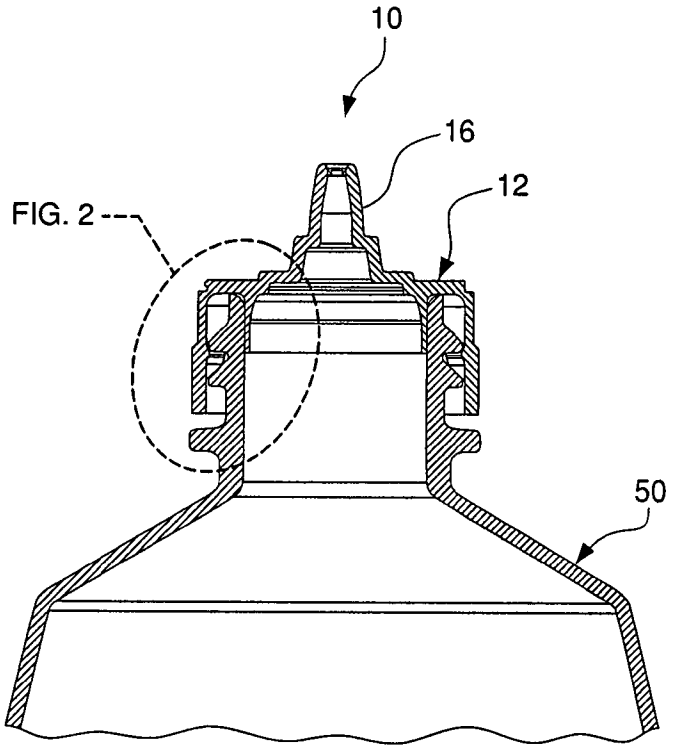
FIG. 1 is a sectional view of the container closure showing the present invention mounted to a container.

Referring to the drawings, where like numerals identify like elements, there is illustrated in FIGS. 1 and 2 a container closure 10 according to an exemplary embodiment of the invention. The container closure 10 includes a dispensing nozzle 16 formed integral with a cap body 12. The cap body 12 may include any conventional dispensing nozzle 16 that can be injection molded or integrally interconnected thereto. Alternatively, the cap body may include non-integral dispensing nozzle or a non-dispensing cap in place of the dispensing nozzle 16. The container closure 10 shown in FIGS. 1 and 2 can be formed by injection molding as a one piece construction.

The cap body 12 includes an outer skirt 34 depending downwardly from a top surface 36. The skirt 34 is designed to secure the container closure 10 to the top opening of a container 50 through any conventional attachment mechanism, such as threads or snap-on engagement. A snap-on attachment is illustrated in FIGS. 1 and 2 wherein an internal annular rib 58 molded onto the skirt 34 mates with an external barb 56 on the container neck 52. It can be readily appreciated that a threaded attachment could replace the snap-on attachment, wherein the annular rib 58 would be replaced by internal threads molded into the skirt 34 and the external barbs 56 would be replaced with mating external threads 64 on the container neck 52.

The cap body 12 further includes a hollow generally cylindrical plug seal 20 depending downwardly from the top surface 36 to engage and seal against the inner wall 54 of the container neck 52. Two raised annular beads 30, 32, formed on the outer surface of the plug seal 20, are in intimate contact with the inner wall 54 of the container neck 52 when the closure 10 is installed onto the container 50. In a preferred embodiment, the lower bead 32 is slightly larger than the upper bead 30.

The plug seal 20 varies in thickness. The varying thickness is designed to provide stiffness where the top surface 36 attaches thereto while at the same time permitting independent movement of the upper and lower beads 30, 32. The plug seal 20 preferably comprises a tapered upper portion 22 that transitions into a substantially constant thickness lower portion 24 at a midpoint 26, the midpoint simultaneously defining the distal end of the upper portion 22 and the proximal end of the lower portion 24. Specifically, the upper portion 22 tapers along its inner wall from a relatively thicker proximal end, located at the junction of the plug seal 20 with the top surface 36, to a relatively thinner distal end, located at the midpoint 26 of the plug seal 20. The lower portion 24 has a substantially constant thickness equal to the thickness of the upper portion 22 at the distal end thereof, and continues from the midpoint 26 of the plug seal 20 to the distal terminus 28 thereof. The midpoint 26, where the tapered upper portion 22 preferably smoothly transitions into the thinner lower portion 24, is preferably located at or below the position of the upper bead 30 and need not be at the halfway point between the proximal and distal ends of the plug seal 20.

Figure 3:
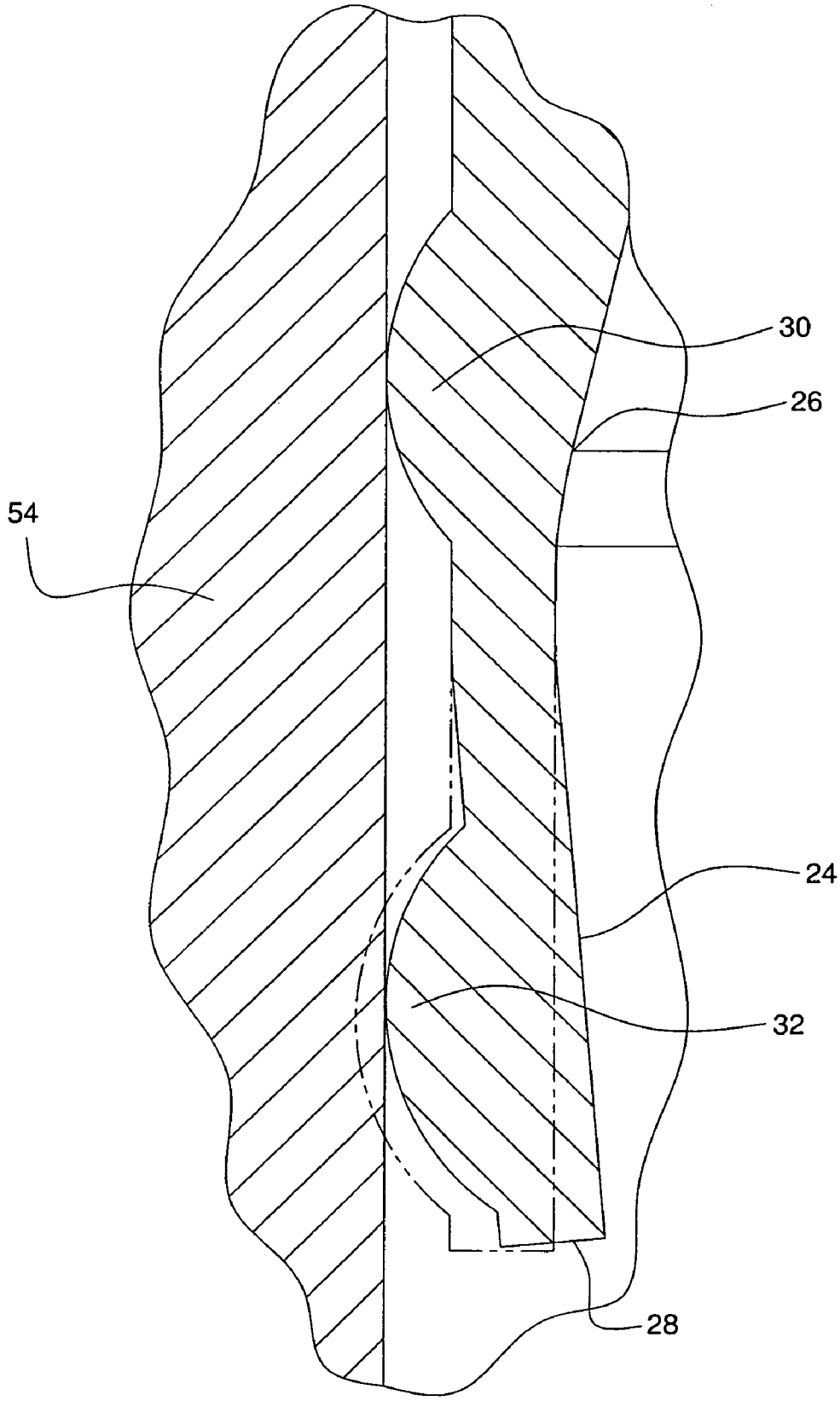
FIG. 3 is an enlarged view for the double bead sealing system illustrating the deflection of the plug seal.

The varied thickness of the plug seal 20 provides multiple advantages. This is illustrated in FIG. 3 which shows, greatly enhanced, the non-deflected (shown in dashed lines) and deflected states of the plug seal to illustrate the present invention. The thicker tapered upper portion 22, located above the upper bead 30, provides enhanced stiffness and strength at the junction between the plug seal 20 and the top surface 36. The thinner lower portion 24 that is located between the beads 30, 32 tends to act like a circular hinge, enabling the lower bead 32 to be more flexible than the upper bead 30 in its engagement with the neck wall 54. Thus, the lower bead 32 is able to flex and seal independently from the upper bead 30. This reduces the dominance of the upper bead 30 over the location of the lower bead 32 and thereby improves the sealing achieved by the lower bead 32. This also reduces the potential that non-uniformities in the neck wall 54 at the location of the lower bead 32 could decrease the sealing capabilities of the upper seal 30. The increased flexibility of the lower bead 32 works in conjunction with the preferably slightly larger size of the lower bead 32 because by being a bit larger than the upper bead 30, the lower bead 32 can flex more relative to the upper bead 30 and still form a consistent seal with the neck wall 54. The additional flexing around the entire perimeter of the lower portion 24 of the plug seal 20 caused by the slightly larger lower bead 32 also tends to create outward pressure near the midpoint 26 that enhances the seal of the upper bead 30.

An additional advantage of the varied thickness of the plug seal 20 is that the thinner lower portion 24 of the plug seal 20 between the midpoint 26 and the distal terminus 28 (which coincides with some or all of the portion of the plug seal 20 between the beads 30, 32) reduces the force required to insert the plug seal 20 into the container neck 52. Further, the wide base of the tapered portion 22 improves the consistency of manufacture of the plug seal 20, providing a thicker lead-in and a more controlled mold flow area for injection molding than if the plug seal 20 were to be of a uniform thin cross-section. The thicker lead-in decreases the possibility of short shots, and in particular ensures consistent molding of the lower bead 32 and the lower portion 24 of the plug seal 20.

By way of non-limiting example, the description of a particular embodiment of the container closure will further elucidate the features of the present invention. In one embodiment, the plug seal 20 has a length equal to approximately one-third its outside diameter, the length being divided nearly equally by the midpoint 26 defining the upper portion 22 and the lower portion 24. The tapered upper portion 22 is about two times as thick at its proximal end as at the midpoint 26 of the plug seal, and more preferably is about 2.3 times. The outer wall of the plug seal preferably is substantially vertical, and the inner wall of the plug seal at the upper portion preferably tapers outwardly at an angle of approximately 10-20 degrees and more preferably at 14 degrees. The substantially constant-thickness lower portion 24 matches the thickness of the upper portion 22 at the midpoint 26 and preferably extends vertically downward from the midpoint 26 to the distal end 28 of the plug seal. The lower portion preferably has a thickness of about 0.019 inches. It should be readily apparent that the lower portion of the plug seal need not have a constant thickness.

The upper bead 30 is formed on the outer wall of the plug seal 20 preferably slightly above the midpoint 26, enlarging the outer diameter of the plug seal 20 by about 2.8%. The lower bead 32 is formed on the outer wall of the plug seal 20 preferably at or near the distal end 28 and is about 20% larger than the upper bead 30. The lower bead increases the outer diameter of the plug seal 20 by about 3.5%. The upper bead is preferably has a radius of about 0.040 inches an protrudes by about 0.009 inches from the outer wall of the plug seal. The lower bead preferably has a radius of about 0.040 inches and protrudes by about 0.011 inches from the outer wall of the plug seal The combination of the upper and lower circumferential beads 30, 32 formed on the outer surface of the plug seal 20 provides a double seal system that has been shown in leak testing to be superior to what can be achieved with a single bead. Additionally, the double bead seal system of the present invention is superior to existing double and multiple bead seals because of the ability of the slightly larger lower bead 32 to flex and seat itself on the neck wall 54 independently from the slightly smaller upper bead 30, which combination provides a consistent seal despite small defects or non-uniformities that may be present along the inner surface of the neck wall 54.

It should be readily apparent that the cap can be used in a variety of orientations. As such, the reference in the application and claims to specific directions such as "upper" and "lower" are for purposes of identifying relative locations of the elements and are not intended to limit the claims to a specific orientation of the cap. For example, if the cap is inverted, the beads would obviously be above the "top" surface, and the thickness of the plug seal would taper (narrow) as the plug seal extends upward.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A closure device for a bottle or other similar container having a neck including an interior surface, comprising:

a top surface;

a hollow substantially cylindrical plug seal having an upper portion and a lower portion joined at a midpoint of the plug seal, the plug seal depending downwardly from the top surface and having an outer wall adapted to engage the interior surface of the neck of a bottle, the upper portion extending from an end proximal to the top surface to the midpoint and the lower portion extending from the midpoint to an end distal from the top surface;

a substantially continuous upper annular bead formed integral to and extending circumferentially around the outer wall of the plug seal;

a substantially continuous lower annular bead formed integral to and extending circumferentially around the outer wall of the plug seal, the lower bead being spaced apart and downward from the upper bead on the plug seal, the lower bead protruding outwardly from the outer wall farther than the upper bead to cause the lower bead to deflect more than the upper bead with respect to the neck when the plug seal is inserted into the neck, thereby creating an outward pressure that enhances the seal of the upper bead with the neck; and a skirt depending downwardly from the top surface and spaced radially outward from the plug seal, the skirt including an attachment means formed on an inside surface of the skirt and adapted to interconnect with a mating attachment means on an outer surface of the neck to retain the closure device on the container.

2. The closure device of claim 1, wherein the upper portion of the plug seal is tapered, the upper portion being thicker at the proximal end of the plug seal and thinner at the midpoint of the plug seal to provide enhanced stiffness at a junction between the upper portion and the top surface, and wherein the lower portion extends at a substantially constant thickness from the midpoint of the plug seal to the distal end of the plug seal to enable the lower bead to deflect and seal independently from the upper bead, and to facilitate insertion of the plug seal into the neck.

3. The closure device of claim 2, wherein the midpoint of the plug seal is located substantially coincident with the upper bead.

4. The closure device of claim 2, wherein the midpoint of the plug seal is located below the upper bead.

5. The closure device of claim 4, wherein the midpoint is located approximately halfway between the upper bead and the lower bead.

6. The closure device of claim 2, wherein the device is integrally formed by injection molding.

7. The closure device of claim 2, wherein the attachment means of the skirt comprises internal threads and the mating attachment means of the neck comprises mating external threads.

8. The closure device of claim 2, wherein the attachment means of the skirt comprises at least one raised internal annular rib and the mating attachment means of the neck comprises at least one mating external barb.

9. The closure device for a bottle or other similar container having a neck including an interior surface, comprising:

a top surface;

a hollow substantially cylindrical plug seal having an upper portion and a lower portion joined at a midpoint of the plug seal, the plug seal depending downwardly from the top surface and having an outer wall adapted to engage the interior surface of the neck of a bottle, the upper portion extending from an end proximal to the top surface to the midpoint and the lower portion extending from the midpoint to an end distal from the top surface;

an upper annular bead formed integral to the outer wall of the plug seal;

a lower annular bead formed integral to the outer wall of the plug seal, the lower bead being spaced apart and downward from the upper bead on the plug seal, the lower bead protruding outwardly from the outer wall farther than the upper bead to cause the lower bead to deflect more than the upper bead with respect to the neck when the plug seal is inserted into the neck, thereby creating an outward pressure that enhances the seal of the upper bead with the neck; and a skirt depending downwardly from the top surface and spaced radially outward from the plug seal, the skirt including an attachment means formed on an inside surface of the skirt and adapted to interconnect with a mating attachment means on an outer surface of the neck to retain the closure device on the container;

wherein the upper portion of the plug seal is tapered, the upper portion being thicker at the proximal end of the plug seal and thinner at the midpoint of the plug seal to provide enhanced stiffness at a junction between the upper portion and the top surface;

wherein the lower portion extends at a substantially constant thickness from the midpoint of the plug seal to the distal end of the plug seal to enable the lower bead to deflect and seal independently from the upper bead, and to facilitate insertion of the plug seal into the neck; and wherein the top surface further comprises a dispensing portion adapted to enable dispensing of the contents of the container.

10. The closure device for a bottle or other similar container having a neck including an interior surface, comprising:

a top surface;

a hollow substantially cylindrical plug seal having an upper portion and a lower portion joined at a midpoint of the plug seal, the plug seal depending downwardly from the top surface and having an outer wall adapted to engage the interior surface of the neck of a bottle, the upper portion extending from an end proximal to the top surface to the midpoint and the lower portion extending from the midpoint to an end distal from the top surface;

an upper annular bead formed integral to the outer wall of the plug seal;

a lower annular bead formed integral to the outer wall of the plug seal, the lower bead being spaced apart and downward from the upper bead on the plug seal, the lower bead protruding outwardly from the outer wall farther than the upper bead to cause the lower bead to deflect more than the upper bead with respect to the neck when the plug seal is inserted into the neck, thereby creating an outward pressure that enhances the seal of the upper bead with the neck; and a skirt depending downwardly from the top surface and spaced radially outward from the plug seal, the skirt including an attachment means formed on an inside surface of the skirt and adapted to interconnect with a mating attachment means on an outer surface of the neck to retain the closure device on the container;

wherein the upper portion of the plug seal is tapered, the upper portion being thicker at the proximal end of the plug seal and thinner at the midpoint of the plug seal to provide enhanced stiffness at a junction between the upper portion and the top surface;

wherein the lower portion extends at a substantially constant thickness from the midpoint of the plug seal to the distal end of the plug seal to enable the lower bead to deflect and seal independently from the upper bead, and to facilitate insertion of the plug seal into the neck; and wherein the top surface further comprises a cap portion adapted to close off the container.

11. An injection molded container closure device comprising:

a top surface;

a hollow substantially cylindrical plug seal depending downwardly from the top surface and having an outer wall adapted to engage with an interior surface of a container neck, the plug seal having an upper portion and a lower portion;

a substantially continuous upper annular bead formed integral to and extending circumferentially around the outer wall of the plug seal on the upper portion; and a substantially continuous lower annular bead formed integral to and extending circumferentially around the outer wall of the plug seal on the lower portion, the lower bead being spaced apart from the upper bead, the lower bead protruding outwardly from the outer wall farther than the upper bead to cause the lower bead to deflect more than the upper bead with respect to the neck when the plug seal is inserted into the neck, thereby creating an outward pressure that enhances the seal of the upper bead with the neck;

wherein the upper portion tapers from the top surface to an intermediate point on the plug seal to provide enhanced stiffness at a junction between the upper portion and the top surface, and wherein the lower portion has a substantially constant thickness from the intermediate point to a lower distal end to enable the lower bead to deflect and seal independently from the upper bead, and to facilitate insertion of the plug seal into the neck.

12. The closure device of claim 11, further comprising a skirt depending downwardly from the top surface and being spaced radially outward form the plug seal, the skirt including an attachment means adapted to interconnect with a mating attachment means on the outer surface of the neck to retain the closure device on the container.

* * * * *